US006566797B2

(12) United States Patent
Reed

(10) Patent No.: US 6,566,797 B2
(45) Date of Patent: May 20, 2003

(54) TENSION MASK FRAME ASSEMBLY HAVING A DETENSIONING MASK SUPPORT FRAME

(75) Inventor: Joseph Arthur Reed, York, PA (US)

(73) Assignee: Thomson Licensing S.A., Boulogne Cedex (FR)

( * ) Notice: Subject to any disclaimer, the term of this patent is extended or adjusted under 35 U.S.C. 154(b) by 100 days.

(21) Appl. No.: 09/928,753

(22) Filed: Aug. 13, 2001

(65) Prior Publication Data

US 2003/0030359 A1 Feb. 13, 2003

(51) Int. Cl.[7] ..... H01J 29/81; H01J 29/06
(52) U.S. Cl. ..... 313/407
(58) Field of Search ..... 313/403, 404, 313/405, 407

(56) References Cited

U.S. PATENT DOCUMENTS 5,111,017 A 5/1992 Kume et al. ..... 313/405
5,424,603 A * 6/1995 Van Den Bekerom ..... 313/407
5,488,263 A * 1/1996 Takemura et al. ..... 313/402
5,952,774 A * 9/1999 Diven et al. ..... 313/402
6,388,369 B1 * 5/2002 Lee ..... 313/403
6,407,488 B1 * 6/2002 Ragland, Jr. ..... 313/402

* cited by examiner

*Primary Examiner*—Michael H. Day
(74) *Attorney, Agent, or Firm*—Joseph S. Tripoli; Joseph J. Laks; Carlos M. Herrera

(57) ABSTRACT

The invention relates to a tension mask frame assembly for a CRT having a substantially rectangular mask support frame. The mask support frame has a pair of long sides extending about a central major axis and a pair of short sides extending about a central minor axis. On at least one pair of these sides, a midsection is disposed between and is continuous with two end sections. The midsection is made of a material having a coefficient of thermal expansion which is less than a coefficient of thermal expansion of the end section material. A tension mask is supported to the mask support frame at attachment points adjacent the pair of sides having the midsection.

8 Claims, 2 Drawing Sheets

TENSION MASK FRAME ASSEMBLY HAVING A DETENSIONING MASK SUPPORT FRAME

FIELD OF THE INVENTION

This invention generally relates to cathode ray tubes (CRTs) having a tension mask and, more particularly, to a tension mask frame assembly for CRTs having a detensioning mask support frame.

BACKGROUND OF THE INVENTION

A color cathode ray tube, or CRT, includes an electron gun for forming and directing three electron beams to a screen of the tube. The screen is located on the inner surface of the faceplate panel of the tube and is made up of an array of elements of three different color-emitting phosphors. A shadow mask, which may be either a formed mask or a tension mask having strands, is located between the electron gun and the screen. The electron beams emitted from the electron gun pass through apertures in the shadow mask and strike the screen causing the phosphors to emit light so that an image is displayed on the viewing surface of the faceplate panel.

One type of CRT has a tension mask comprising a set of strands that are tensioned onto a mask support frame to reduce their propensity to vibrate at large amplitudes under external excitation. Such vibrations would cause gross electron beam misregister on the screen and would result in objectionable image anomalies to the viewer of the CRT.

The mask stress required to achieve acceptable vibration performance is below the yield point of the mask material at tube operating temperature. However, at elevated tube processing temperatures, the mask's material properties change and the elastic limit of the mask material is significantly reduced. In such a condition, the mask stress exceeds the elastic limit of the mask material and the material is inelastically stretched. When the tube is cooled after processing, the strands are longer than before processing and the mask frame is incapable of tensing the mask strands to the same level of tension as before processing.

It is desirable to develop a mask frame assembly that allows tension masks to be effectively detensioned during the thermal cycle used to manufacture a CRT to mitigate stretching of the mask.

SUMMARY OF THE INVENTION

This invention relates to a tension mask frame assembly for a CRT having a substantially rectangular mask support frame. The mask support frame has a pair of long sides extending about a central major axis and a pair of short sides extending about a central minor axis. On at least one pair of these sides, a midsection is disposed between and is continuous with two end sections. The midsection is made of a material having a coefficient of thermal expansion which is less than a coefficient of thermal expansion of the end section material. A tension mask is supported to the mask support frame at attachment points along the pair of long sides.

BRIEF DESCRIPTION OF THE DRAWINGS

The invention will now be described by way of example with reference to the accompanying figures of which.

DETAILED DESCRIPTION OF THE INVENTION

Figure 1:
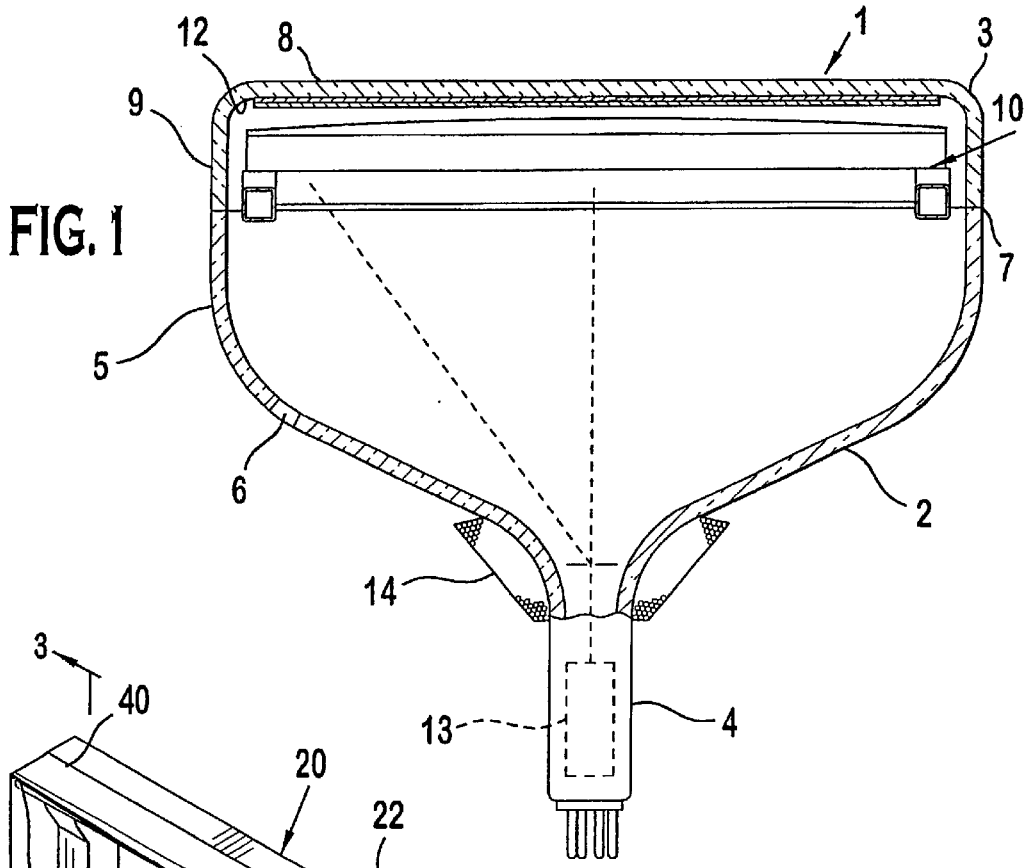
FIG. 1 is a cross sectional view of a CRT showing a tension mask frame assembly.

FIG. 1 shows a cathode ray tube (CRT) 1 having a glass envelope 2 comprising a rectangular faceplate panel 3 and a tubular neck 4 connected by a funnel 5. The funnel 5 has an internal conductive coating (not shown) that extends from an anode button 6 toward the faceplate panel 3 and to the neck 4. The faceplate panel 3 comprises a viewing faceplate 8 and a peripheral flange or sidewall 9, which is sealed to the funnel 5 by a glass frit 7. A three-color phosphor screen 12 is carried by the inner surface of the faceplate panel 3. The screen 12 is a line screen with the phosphor lines arranged in triads, each of the triads including a phosphor line of each of the three colors. A tension mask frame assembly 10 is removably mounted in predetermined spaced relation to the screen 12. An electron gun 13, shown schematically by dashed lines in FIG. 1, is centrally mounted within the neck 4 to generate and direct three inline electron beams, a center beam and two side or outer beams, along convergent paths through the tension mask frame assembly 10 to the screen 12.

The CRT 1 is designed to be used with an external magnetic deflection yoke 14 shown in the neighborhood of the funnel-to-neck junction. When activated, the yoke 14 subjects the three beams to magnetic fields which cause the beams to scan horizontally and vertically in a rectangular raster over the screen 12.

Figure 2:
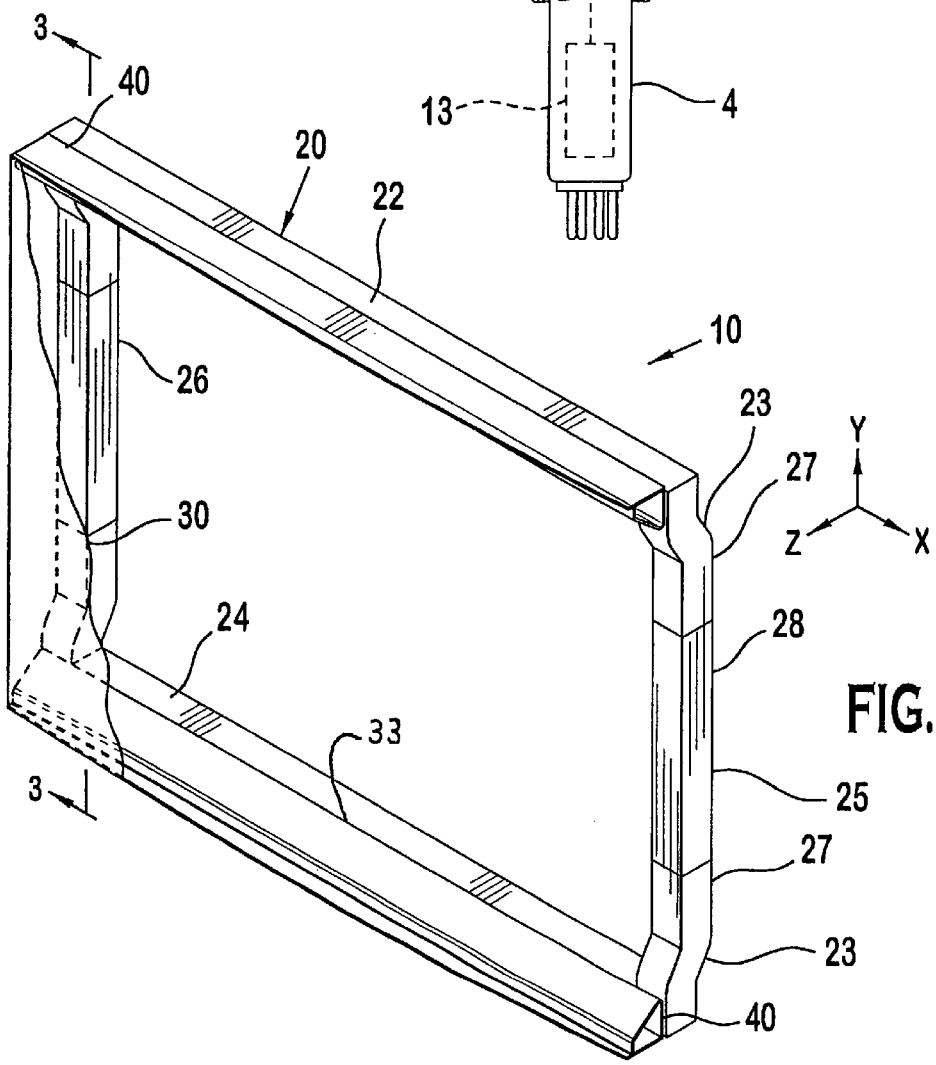
FIG. 2 is a perspective view of the tension mask frame assembly.

The tension mask frame assembly 10, as shown in FIG. 2, includes two long sides 22 and 24, and two short sides 26 and 28. The two long sides 22, 24 of the tension mask frame assembly 10 are parallel to a central major axis, X, of the tube; and the two short sides 26, 28 are parallel to a central minor axis, Y, of the tube. The sides 22, 24, 26, 28 are preferably formed of rectangular tubular material. It should be understood however that other geometry tubular materials or other solid materials could be utilized to form these sides. The short sides 26, 28 have angled portions 23 located within end sections 27. Midsections 25 are located between and connect the end sections 27. The two long sides 22, 24 and two short sides 26, 28 preferably form a continuous mask support frame 20 in which the long sides 22, 24 lie in a common plane generally parallel to a tension mask 30 while the midsections 25 lie outside that plane and farther away from the tension mask 30. Alternatively, the two long sides 22, 24 and two short sides 26, 28 may form a continuous planar mask support frame 20 along the major and minor axes wherein both lie in the same plane.

Figure 3:
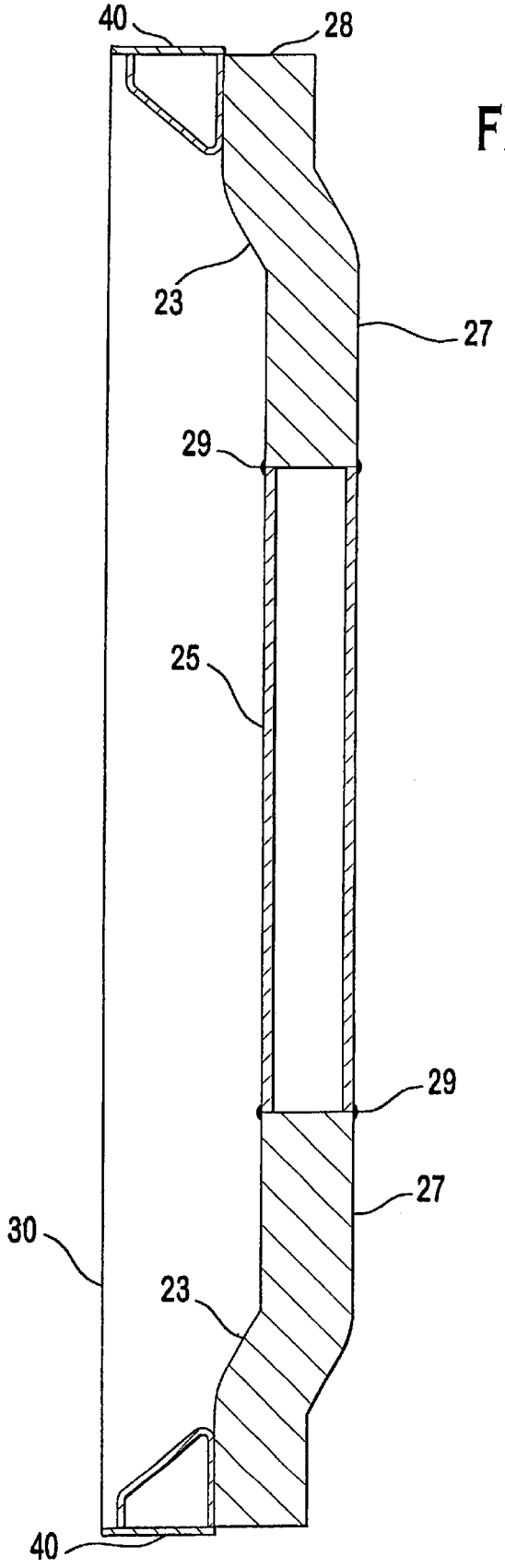
FIG. 3 is a cross sectional view taken along the line 3—3 of FIG. 2.

Referring now to FIGS. 2–3 each of the short sides 26, 28 will be described in greater detail. Since these sides are identical, only the short side 28 will be described with the assumption that the same description applies to the short side 26. The short side 28 has a midsection 25 formed of a material having a relatively low coefficient of thermal expansion. An example of such a material, which is suitable for the midsection 25, is Invar (trademark, iron-nickel alloy). A pair of end sections 27 extends outward from each end of the midsection 25 to form a continuous short side 28. The end sections 27 are each formed of a material having a relatively high coefficient of thermal expansion. An example of such a material suitable for the end sections 27 is steel. While steel and Invar are suitable materials, others can be used which have similar low to high coefficient of thermal expansion relationships to each other. Each end section 27 includes an angled portion 23 located between the end that extends from the midsection 25 and the end that meets its respective long side 22, 24. The end sections 27 are preferably welded to the ends of the midsection 25 at weld points 29.

The tension mask frame assembly 10 includes an apertured tension mask 30 (shown here diagrammatically as a sheet for simplicity) that contains a plurality of metal strips (not shown) having a multiplicity of elongated slits (not shown) therebetween that parallel the minor axis, Y, of the tube. The tension mask 30 is fixed to a pair of support blade members 40 which are fastened to the mask support frame 20 at mounting locations 33 (as shown best in FIG. 2). The support blade members 40 may vary in height from the center of each support blade member 40 longitudinally to the ends of the support blade member 40 to permit the best curvature and tension compliance over the tension mask 30.

In use, the tension mask frame assembly 10 is designed to detension the tension mask 30 during the heating cycles of tube processing. During heating, the midsection 25 expands at a lower rate and the end sections 27 expand at a higher rate. This expansion characteristic causes the short sides 26, 28 to expand less than the tension mask 30 to relieve tension on the mask along the minor axis Y. It should be understood by those reasonably skilled in the art that the midsections 25 could alternatively be applied to the long sides 22, 24 to achieve similar detensioning along the major axis X.

What is claimed is:

1. A tension mask frame assembly for a CRT comprising:

a substantially rectangular mask support frame having a pair of long sides extending about a central major axis and a pair of short sides extending about a central minor axis;

at least one of the pair of long and short sides having a midsection disposed between and being continuous with two end sections, the midsection having a coefficient of thermal expansion which is less than a coefficient of thermal expansion of the end sections; and, a tension mask supported to the mask support frame at attachment points along the pair of sides adjacent the sides having the midsection.

2. The tension mask frame assembly of claim 1 wherein the end sections and the midsections are disposed along the short sides.

3. The tension mask frame assembly of claim 2 wherein each end section further comprises an angled portion between the midsection and the ends.

4. The tension mask frame assembly of claim 1 wherein the tension mask is supported by support blade members being attached to the frame at the attachment point.

5. The tension mask frame assembly of claim 4 wherein the attachment points are located approximately in the center of each long side.

6. A tension mask frame assembly for a cathode ray tube having a tension mask comprising:

a mask support frame having a pair of a first opposing sides paralleling a central major axis thereof with each first opposing sides having a support blade member attached thereto;

a pair of second opposing sides paralleling a central minor axis and extending between the first opposing sides, the second opposing sides each having a pair of end sections extending from and continuous with a midsection, each end section being connected to the ends of the first opposing sides, the midsection having a coefficient of thermal expansion which is less than a coefficient of thermal expansion of the end sections.

7. The tension mask frame assembly of claim 6 wherein each end section further comprises an angled portion between the midsection and the end sections.

8. The tension mask frame assembly of claim 6 wherein each support blade members are attached at points located approximately in the center of each first opposing side.

* * * * *